US005722561A

United States Patent [19]

Biondich et al.

[11] Patent Number: 5,722,561

[45] Date of Patent: Mar. 3, 1998

[54] DRINK STRAW CAN

[75] Inventors: Scott C. Biondich, Delmont; Dean J. Wainer, Lower Burrell, both of Pa.; Robert J. Falkenberg, Alpharetta, Ga.

[73] Assignee: Aluminum Company of America, Pittsburgh, Pa.

[21] Appl. No.: 614,874

[22] Filed: Mar. 13, 1996

[51] Int. Cl.[6] ..... B65D 77/28

[52] U.S. Cl. ..... 220/710; 220/359; 220/363

[58] Field of Search ..... 220/705–710, 220/359, 361, 362, 363

[56] References Cited

U.S. PATENT DOCUMENTS

| | | | |
|---|---|---|---|
| 3,397,830 | 8/1968 | Chang . | |
| 3,656,654 | 4/1972 | Brinkley, III . | |
| 3,874,554 | 4/1975 | Chang . | |
| 3,945,528 | 3/1976 | Mowrey, Jr. . | |
| 4,095,710 | 6/1978 | Tomiati | 220/708 |
| 4,109,817 | 8/1978 | Payne et al. . | |
| 4,228,913 | 10/1980 | Mack et al. . | |
| 4,709,829 | 12/1987 | Johnson et al. . | |
| 4,733,785 | 3/1988 | Turner, Jr. et al. . | |
| 4,826,034 | 5/1989 | Forbes . | |
| 4,828,135 | 5/1989 | Kawakami et al. . | |
| 4,877,148 | 10/1989 | Larson et al. . | |
| 4,892,187 | 1/1990 | Stein . | |
| 4,930,652 | 6/1990 | Murphy et al. . | |
| 4,976,367 | 12/1990 | Hoefler . | |
| 5,052,614 | 10/1991 | Xuan | 220/710 |
| 5,054,639 | 10/1991 | Ahn . | |
| 5,147,065 | 9/1992 | Rush et al. . | |
| 5,201,459 | 4/1993 | Bettle, Jr. et al. . | |
| 5,253,779 | 10/1993 | Lee . | |
| 5,275,304 | 1/1994 | Abram | 220/710 |
| 5,348,217 | 9/1994 | Bettle, Jr. et al. . | |
| 5,431,297 | 7/1995 | Rosello . | |

FOREIGN PATENT DOCUMENTS

| | | | |
|---|---|---|---|
| 174564 | 3/1922 | United Kingdom | 220/709 |

*Primary Examiner*—Joseph M. Moy
*Attorney, Agent, or Firm*—David W. Brownlee; E. L. Levine

[57] ABSTRACT

A pressurized can for beverage having a small opening in its lid which is sealed with a patch on the inside of the lid and which is adapted to receive a drink straw removably attached to the outside of the can.

10 Claims, 1 Drawing Sheet

DRINK STRAW CAN

BACKGROUND OF THE INVENTION

1. Field of the Invention

The present invention relates to metal cans for beverages and in particular to a metal can for pressurized contents having an aperture in the top lid on the can with a patch on the lid under the aperture which can be pierced by a drink straw removably attached to the outside of the can.

2. Description of Related Art

It is known to provide a paperboard beverage container having a covered access hole in its top wall for receiving a drink straw as is disclosed by U.S. Pat. Nos. 5,201,459 and 5,348,217. The access hole is covered with aluminum foil or other sheet material secured to the container and the drink straw may have a point on it to facilitate rupture of the covering material. These containers are flexible and are adapted for holding unpressurized beverages. Due to their flexibility, the containers are prone to spillage of products by some consumers such as children. Parents sometimes select flavors which are less likely to stain when spilled by their children.

It is also well known to provide substantially rigid beverage cans and other containers having straws in them which will pop-up or be readily accessible upon opening of the cans. Such cans are disclosed in U.S. Pat. Nos. 3,397,830; 3,656,654; 3,874,554; 4,109,817; 4,228,913; 4,709,829; 4,737,785; 4,826,034; 4,877,148; 4,892,187; 4,930,652; 5,054,639; 5,253,779 and 5,431,297. Most of these pop-up straw cans are complex and expensive to manufacture.

An improved can is desired for containing beverage which is under pressure from carbonation in the beverage or as a result of having been hot filled and which is suitable for use by children or others who desire to drink through a straw. Such a drink straw "kids' can" should be inexpensive to produce, easy to use, and minimize spillage when used by children. A kids' can of this type is desired which is particularly designed for children in the 2 to 6 year old age range.

SUMMARY OF THE INVENTION

This invention provides a beverage can which holds internal pressure of at least about 40 psi, and possibly as high as 90 psi or more, sometime during processing or storage of the filled can and which has a sealed opening in its top wall for receiving a straw that is preferably removably attached to the outside of the can. The opening is sealed with a patch or strip of plastic tape, foil or a foil laminate on the inside surface or product side of the top wall with the patch having an adhesive shear strength sufficient to hold the internal pressure in the can. The opening is only slightly larger than the straw to minimize the total force of the internal pressure against the patch over the opening, but large enough to permit venting of air or gas between the straw and the edge of the opening around the straw. The patch is preferably made of a strip of polymer material or laminated material which is substantially impervious to liquid and gases. If the patch includes foil, it should have no exposed metal edges that could be attacked by the contents of the container. The material of the patch is preferably tearable or frangible so it will tear when pierced by the straw and will not fit snugly around the straw. This permits gas or air to flow between the straw and the patch material around the straw within the opening in the lid.

A principal objective of this invention is to provide an inexpensive, convenient, drink straw beverage can which is suitable for holding pressure of at least about 40 psi sometime during processing or storage of the filled can.

The above and other objects and advantages will be more fully understood and appreciated by reference to the following specification and drawings.

DESCRIPTION OF THE PREFERRED EMBODIMENT

As used herein, the terms upwardly and downwardly are used with respect to a can sitting on a surface in the normal upright position, and the terms inside, inwardly, outside and outwardly are used with respect to the interior and exterior of a can halving a lid or top end wall on it. The terms public and product surfaces mean the outside and inside surfaces of the can and can lid.

Figure 1:
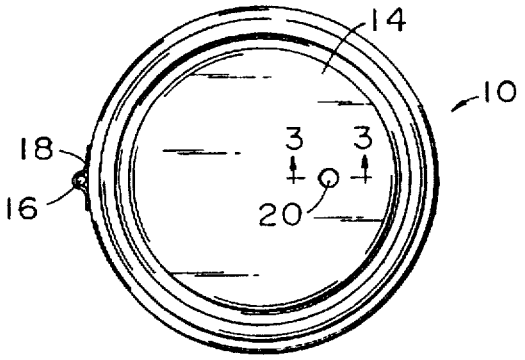
FIG. 1 is a top view of a preferred embodiment of a can of this invention in partial cross section.
Figure 2:
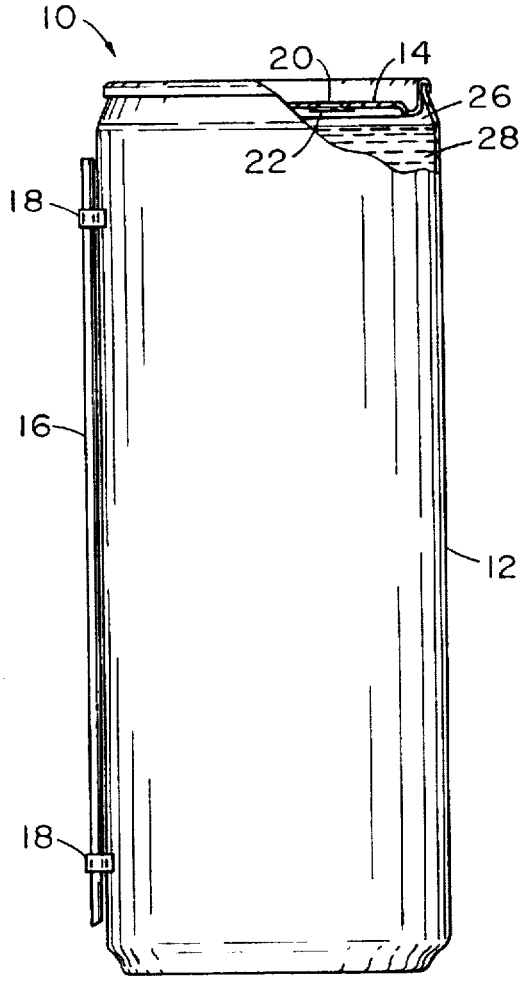
FIG. 2 is a side elevational view of the can of FIG. 1.

FIGS. 1 and 2 show a can 10 of this invention which includes a can body 12, a lid 14 and a drink straw 16 removably attached to an exterior or public surface of the can. The can body 12 and lid 14 are preferably made of aluminum or an aluminum alloy but may also be made of steel or other materials. Such cans are substantially rigid during normal use in that the side wall of the cans do not collapse when held by the consumer. The can is preferably designed to hold approximately 4–8 ounces or more of beverage for consumption by individuals such as small children who consume small quantities. The can of this invention is designed to hold pressures exceeding 40 psi for hot filled applications and about 90 psi for carbonated beverages. The pressure which results from hot filling of an 8 ounce can is typically about 47–48 psi. Carbonated beverage cans may have internal pressures of 80–90 psi or more.

Figure 3:
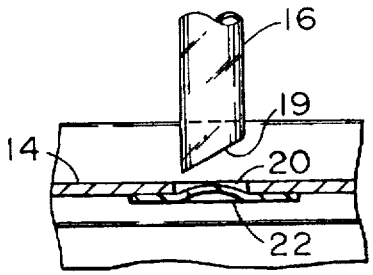
FIG. 3 is an enlarged partial cross-sectional view of a portion of a can of this invention taken along line 3—3 of FIG. 1 and a straw just prior to insertion of the straw into the can.
Figure 4:
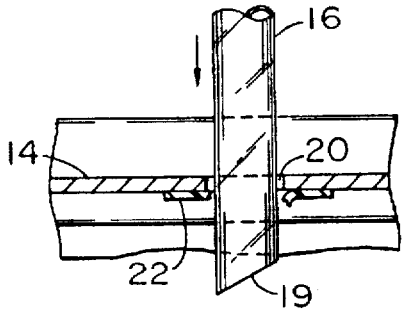
FIG. 4 is an enlarged partial cross-sectional view similar to FIG. 3 showing the straw inserted into the can.

The straw 16 is preferably made of plastic and is preferably shorter than the height of the can 10 when secured to the can by means of tape 18 or releasable adhesive and is adapted to be extended to have a length greater than the height of the can. Telescoping straws that can be extended in this manner are known in the art and commercially available from companies such as Tibus, The Straw People, of Stanford, Conn. Upon being telescoped to its extended length, the straw preferably locks in such position so it is not likely to be inadvertently shortened. The straw 16 preferably has a pointed or angular end 19 on one end as shown in FIGS. 3 and 4.

The can 10 of this invention further has an aperture or hole 20 in its lid 14 which is closed and sealed with a patch 22 or strip of plastic tape, foil, foil laminate or the like which is adhered or bonded to the inside or product side of the lid. The patch 22 is preferably made of polymer material or a laminate of polymer materials which will not adversely affect the flavor of the can's contents and which will provide good barrier properties against penetration of moisture and gases such as oxygen, carbon dioxide and nitrogen. The patch material which will be contacted by the product in the can must also be FDA approved. Some suitable polymer tapes include polyethylene, polyester, and metallized polyester similar to materials which are available from the 3M Company, among others. The patch material may include metal powder or metal foil to enhance resistance to moisture and gas penetration, but exposure of bare metal should be avoided as for instance along the cut edges of the tape. The patch may also be colored to provide a better target for inserting the straw, and the lid may be decorated with a design such as a face with a mouth around the patch or a bull's-eye for locating the hole 20 for insertion of the straw.

The adhesive between the patch 22 and the lid 14 must have sufficient strength in shear to hold the patch in position against the force of internal pressure in the can 10 which might otherwise push or blow the tape through the opening 20 and also to prevent pulling the patch from the lid when the straw punctures the patch. Some suitable adhesives include pressure sensitive synthetic rubbers and resins which are available from the 3M Company. These are desirable for use with a patch that is adapted to be applied to the lid with pressure and without the need for heat to form a seal. This permits faster attachment of the patch or tape which is important for high volume production of cans of this invention.

The patch must also be puncturable by the end of the straw and is preferably tearable or frangible to propagate tearing when pierced by a straw so as to provide gaps for air and gas flow between the straw and the torn edges of the patch. The gaps, however, are preferably small enough to substantially prevent liquid contents of the can from escaping even when the can is tipped on its side. A typical polyethylene or polyester patch or tape may be about 0.003–0.015 inch thick, depending on material properties, to provide the necessary strength and sealing capability while still being puncturable with a straw.

It is important to this invention that the aperture 20 be relatively small so as to minimize the area of unsupported tape 22 covering the aperture, but large enough to receive a straw with space between the straw and the edge of the aperture for venting of air or gases out of and into the can. For example, in one embodiment of the invention the aperture 20 is approximately 5.54 mm in diameter to receive a straw 16 having an outside diameter of about 5.00 mm. It is believed that the aperture may have a diameter in the range of about 5.00–6.00 mm and that the straw may have an outer diameter in a range of about 4.50–5.50 mm, and preferably with the straw diameter that is about 0.040–0.060 mm less than the diameter of the aperture.

Figure 5:
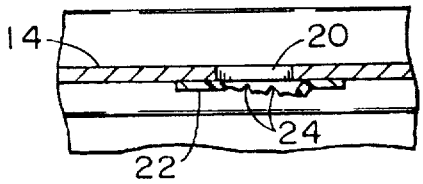
FIG. 5 is an enlarged partial cross-sectional view similar to FIG. 4 showing the can with the straw removed from it.

FIG. 3 shows the bottom, piercing end 19 of a straw 16 preparatory to inserting the straw into the opening 20 in the can lid 14 to pierce the patch 22 which spans the opening. FIG. 4 shows the straw after it has been partially inserted into the can. As seen in FIG. 4, there is a gap or gaps between the straw 16 and the opening 20 to permit air to enter the can while the can is being emptied by a consumer drawing beverage through the straw, but small enough to prevent or minimize liquid contents from escaping through the gaps when the can is overturned. FIG. 5 shows the patch 22 after removal of the straw and shows several small tears 24 in the patch material.

Cans of this invention also preferably have a head space 26 of gas above the liquid contents 28 in the can (FIG. 2). This head space 26 may be approximately 0.40 to 0.60 inch high and typically contain carbon dioxide, nitrogen or mixtures thereof which may be under pressures of 10–90 psi or more. When the patch 22 is punctured with a straw 16, gas in the head space escapes through the straw and around the straw to quickly relieve the pressure and, for all practical purposes, avoid squirting of the cans contents out through the straw. Since the can 10 is substantially rigid, it is not collapsed by the user's grip on the can. Thus, the drink straw can of this invention is not prone to squirting of liquid contents through or around the straw.

It is therefore seen that this invention provides an improved can for pressurized beverages which has a sealed aperture or hole in its top wall or lid which is adapted to receive a drink straw. The aperture is small and sealed with a patch that is secured on the product side of the lid in such a way that the sealed aperture will not be breached by pressure in the can in a range of 40–100 psi or more. The pressure in the can also provides tamper evidence in that any tampering or opening of the patch and the can will be evidenced by the side wall of the can being slightly flexible or squeezable. The can of this invention is inexpensive, easy to use and spill resistant. It is especially suitable for use by small children.

A preferred embodiment of the invention which has been described above is not limiting of the numerous modifications which will be apparent to those skilled in the art without departing from the scope as defined in the appended claims. For example, the drink straw could be secured on the side of the can by plastic sheet material or metal foil which completely covers the straw and protects it against contamination. Various straws such as J-straws or U-straws having a flexible end or portion may also be used. Such a straw could be secured on a can in much the same way as the telescoping shown in the FIGS. 1 and 2 except that the flexible end could be wrapped part way around the outside of the can. This invention can also be used in combination with a conventional easy-opening end to provide alternative openings and drinking or pouring options for the consumer. The lid could also have a patch on the public side over the aperture in addition to the patch on the product side of the lid. Another alternative would be to make the lid for the can out of plastic or a laminate of plastic and metal.

What is claimed is:

1. In a metal can lid for a can holding beverage under a positive pressure that may exceed 40 psig, said lid having a public side and a product side, the improvement comprising a small aperture in said lid and a patch of tearable sheet sealing material having a thickness less than about 0.015 inch covering said aperture on the product side of said lid and adhered to said product side by an adhesive having a shear strength sufficient to prevent said patch from being forced through said aperture by pressure in the can, said patch doming outwardly into said aperture by pressure in the can without bursting and being breakable by a piercing point on a straw to provide access to beverage in a can on which said lid is secured.

2. A can lid as set forth in claim 1 wherein said patch has edges which are substantially chemically non-reactive with beverages.

3. A can lid as set forth in claim 1 wherein said patch is made of coated aluminum foil.

4. A can lid as set forth in claim 1 wherein said aperture has a diameter of about 5.00 to 6.00 mm.

5. In a substantially rigid can and lid for holding beverage under a positive pressure that may exceed 40 psig, said lid having a public side and a product side, the improvement comprising a small aperture in said lid and a patch of tearable sheet sealing material having a thickness less than about 0.015 inch covering said aperture on the product side of said lid and adhered to said product side by an adhesive having a shear strength sufficient to present said patch from being forced through said aperture by pressure in the can, said patch doming outwardly into said aperture by pressure in the can without bursting and being breakable by a piercing point on a straw to provide access to beverage in the can.

6. A can and lid as set forth in claim 5 which has a drink straw removably attached thereto.

7. A can and lid as set forth in claim 6 wherein said straw is a telescoping straw having a collapsed length less than the height of said can and an extended length greater than the height of said can.

8. A can and lid as set forth in claim 5 wherein said patch is made of coated aluminum foil.

9. A can and lid as set forth in claim 5 which is filled with a drinkable beverage and has a small head space of gas between the beverage and said lid.

10. A can and lid as set forth in claim 5 in which any loss of pressure in the can provides evidence of any tampering with the can and lid.

* * * * *